United States Patent [19]

Sugaiwa et al.

[11] Patent Number: 4,842,971

[45] Date of Patent: Jun. 27, 1989

[54] PHOTORECEPTOR FOR ELECTROPHOTOGRAPHY HAVING A HYDROXYSTYRENE SUBBING LAYER

[75] Inventors: Takayuki Sugaiwa; Akira Kinoshita; Kiyoshi Sawada, all of Hino, Japan

[73] Assignee: Konishiroku Photo Industry Co., Ltd., Tokyo, Japan

[21] Appl. No.: 30,694

[22] Filed: Mar. 25, 1987

[30] Foreign Application Priority Data

Mar. 28, 1986 [JP] Japan ..... 61-70081

[51] Int. Cl.[4] ..... G03G 5/14

[52] U.S. Cl. ..... 430/64; 430/58

[58] Field of Search ..... 430/60, 64; 526/313

[56] References Cited

U.S. PATENT DOCUMENTS

| | | | |
|---|---|---|---|
| 4,139,380 | 2/1979 | Matsuo et al. | 430/60 |
| 4,281,055 | 7/1981 | Moriguchi et al. | 430/60 |
| 4,391,888 | 7/1983 | Chang et al. | 430/57 |
| 4,427,754 | 1/1984 | Uchida et al. | 430/60 |

*Primary Examiner*—J. David Welsh

*Attorney, Agent, or Firm*—Jordan B. Bierman

[57] ABSTRACT

Disclosed is a photoreceptor for electrophotography comprising a conductive support and a subbing layer thereon made of a hydroxystyrene polymer or copolymer. A photosensitive layer is formed on the subbing layer and may comprise a carrier generator layer and transport layer. Optionally, a surface protective layer may be present.

21 Claims, 1 Drawing Sheet

PHOTORECEPTOR FOR ELECTROPHOTOGRAPHY HAVING A HYDROXYSTYRENE SUBBING LAYER

FIELD OF THE INVENTION

The present invention relates to a photo-receptor for electrophotography, in particular to a photo-receptor for electrophotography which excells in various properties including the sensitivity, dark-attenuation properties, charge acceptability, repeatability and the like.

BACKGROUND OF THE INVENTION

Conventionally, inorganic photo-conductive materials such as Se, CdS, ZnO and the like have been widely used in the photosensitive layer used in a photo-receptor for electrophotography. On the other hand, the researches for superseding these inorganic photo-conductive materials with organic photo-conductive materials have been widely carried out these years. Compared to the inorganic photo-conductive materials, the organic photo-conductive materials have advantages that they can provide a photosensitive layer being much flexible and easy to manufacture and having stable electrophotographic properties, at the lower cost. Accordingly, many proposals for the organic photo-conductive materials have been offered recently. Among them, a photo-receptor whose photosensitive layer comprises separately provided carrier generating layer and carrier transporting layer has been put to practical use, since it is highly sensitive and diverse options are available to select starting materials for it, in accordance with the specific functions.

The separated function type photo-receptor usually comprises a carrier generating layer and a carrier transporting layer which are disposed, in this sequence, on an electroconductive support by coating, so that the most of incident light can be absorbed in the carrier generating layer to generate carrier and the generated carrier can be injected into the carrier transporting layer without deactivation due to recombination and capture.

For the purposes, including the prevention of deterioration of electrical properties in the photosensitive layer, and the prevention of injection of charge from the electro-conductive support into the light-sensitive layer, the provision of the subbing layer bewteen the electro-conductive support and the photosensitive layer has been being studied.

The known resins used in the subbing layer include nitrocellulose resins (cf. Japanese Patent Publication Open to Public Inspection, hereinafter, Japanese Patent O.P.I. Publication, No. 3544/1973), polyvinylbutyral resins (cf. Japanese Patent O.P.I. Publication Nos. 28837/1975 and 36258/1984), polyvinyl alcohol resins (cf. Japanese Patent O.P.I. Publication No. 100240/1977), nylon resins soluble in alcohol solvent (cf. Japanese Patent O.P.I. Publication No. 25638/1977), polyvinylformal resins (cf. Japanese Patent O.P.I. Publication No. 90639/1982), water-soluble polyvinylbutyral resins (cf. Japanese Patent O.P.I. Publication No. 106549/1983), blends of polyvinylbutyral resin and phenol resin (cf. Japanese Patent O.P.I. Publication No. 36259/1984), and others. Also, the following resins are also known: polyvinylmethylether, polyvinylimidazole, polyethyleneoxide, polyurethane, polyamide, melamine, polyvinylpyrolidone, cellulose ester, casein, gelatin and othre resins.

However, the provision of subbing layer usually deteriorates the photo-conductivity in the photosensitive layer, inevitably jeopardizing the sensitivity of photo-receptor for electrophotography.

As the higher sensitivity of photo-receptor has been realized as a result of recent study of separated function type photo-receptor, the exertive effects of the properties of a subbing layer as well as the thickness variation of the similar layer on the properties of photo-receptor have been increasingly greater. Accordingly, there is a mounting requirement for the development of the subbing layer which without deterioration of sensitivity can improve the properties including the dark attenuation properties, charge acceptability, durability and the like as well as of the subbing layer featuring the wider range of allowable layer thickness.

SUMMARY OF THE INVENTION

Therefore, it is the object of the present invention to provide the following:

1 a photo-receptor for electrophotography having satisfactory sensitivity, excellent dark attenuation properties, and satisfactory charge acceptability;

2 a photo-receptor for electrophotography being excellent in repeatability and having the stable accepted potential, rest potential and sensitivity properties even after repeated cycles of electrification, exposure and neutralization.

Thus the present invention specifically relates to a photo-receptor for electrophotography which comprises an electro-conductive support and provided thereon a subbing layer and a photosensitive layer, wherein said subbing layer comprises a polymer containing a hydroxystyrene as a monomer constituent.

BRIEF DESCRIPTION OF THE DRAWINGS

Each of FIGS. 1~4 is a partial cross section illustrating the preferred layer constitution of photo-receptor for electrophotography according to the invention; wherein,

1: Electro-conductive support
2: Subbing layer
3: Carrier generating layer
4: Carrier transporting layer

DETAILED DESCRIPTION OF THE INVENTION

A photo-receptor for electrophotography of the invention comprises an electro-conductive support, provided thereon, a subbing layer and a photosensitive layer.

As a preferred layer constitution for the photo-receptor, the layer constitutions (1)~(4), below, are available.

Figure 1:
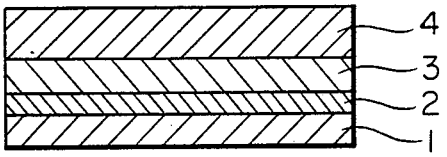

(1) As shown in FIG. 1, the receptor comprising, from bottom upward, an electro-conductive support 1, a subbing layer 2, a carrier generating layer and a carrier transporting layer 4.

Figure 2:
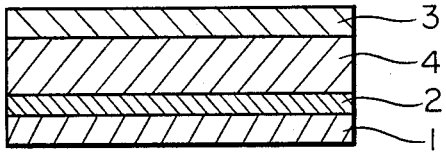

(2) As shown in FIG. 2, the receptor comprising, from bottom upward, an electro-conductive support 1, a subbing layer 2, a carrier transporting layer 4 and a carrier generating layer 3.

Figure 3:
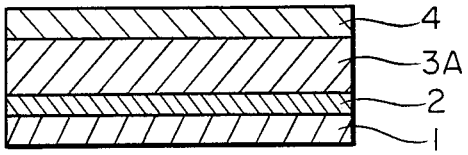

(3) As shown in FIG. 3, the receptor comprising, from bottom upward, an electro-conductive support 1, a subbing layer 2, a carrier generating layer 3A containing carrier generating material and carrier transporting material, and a carrier transporting layer 4.

Figure 4:
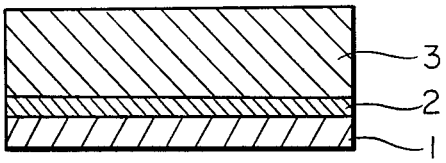

(4) As shown in FIG. 4, the receptor comprising an electroconductive support 1, provided thereon, only a carrier generating layer 3 into which only carrier generating material or both carrier generating material and carrier transporting material having been uniformly dispersed or dissolved.

With the above-mentioned layer constitutions, an intermediate layer may be sandwiched bewteen each neighboring layers, and the topmost layer may be made a surface protective layer.

As an electro-conductive support, a metal such as aluminum, brass, stainless steel or the like is used in the form of a drum, or a sheetlike film or foil. Also, an electrically insulating material like a high polymer such as polyethyleneterephthalate, nylon, polyarylate, polymide, polycarbonate or the like, or a hard paper, in the form of a drum or a sheet-like film, can be used by subjecting it to a conductivity-providing treatment. The conductivity-providing treatments include the impregnation of conductive substance, the lamination of metal foil (such as an aluminum foil), the deposition of metal (such as aluminum, indium, tin oxide, yttrium and the like), and other methods.

The subbing layer is a layer whose principal component is a hydroxystyrene polymer or a copolymer resin containing hydroxystyrene as a polymeric component.

A hydroxystyrene polymer or a copolymer containing hydroxystyrene as a polymeric component, according to the invention, is a resin containing a styrene monomer unit having hydroxyl group, and may have a substituent such as an alkyl group or a halogen atom, besides hydroxyl group. Such a resin can be usually prepared by subjecting hydroxystyrene or the similar substance having a substituent, independently or together with an optional appropriate polymeric monomer such as styrene, acrilic ester, methacrilic ester, acrylonitrile, ethylene, propylene, vinyl acetate, vinyl chloride, vinylidene chloride and the like, to the heat polymerization, radical polymerization or ion polymerization.

The subbing layer of the invention is formed in the specified thickness by dissolving the resin, above, into a solvent which is coated on an electro-conductive support. The solvents advantageously used for this purpose include tetrahydrofuran, methanol, ethanol, butanol, acetone, ethyl acetate, dioxane and the like. Also, the mixtures of ketone solvent and alcohol solvent, ether solvent and ketone solvent, aromatic solvent and alcohol solvent, and the like are advantageously used. In relation to the coating method, if the electroconductive support is of a drum-shape, the dipping process, spray process, extrusion process, slide hopper process or the like is advantageous. If such a support is of a sheet type, the roll process, extrusion process, slide hopper process or the like is advantageously used. The thickness of the subbing layer prepared through any of the processes, above, is favorably within the range of $0.01 \sim 10$ μm, or, more favorably, $0.05 \sim 2$ μm.

The subbing layer may contain, if it does not hinder the operation of the invention, the resin other than hydroxystyrene polymer, or fine particles of carbon, titanium oxide, magnesium oxide, aluminum, colloidal silica or the like. The resins other than hydroxystrene polymer include high polymers such as acrylic resin, methacrylic resin, vinyl chloride resin, vinyl acetate resin, epoxy resin, urethane resin, polyester resin, phenol resin, alkyd resin, polycarbonate resin, silicon resin, melamine resin, polyvinylformal resin, polyvinylbutyral resin, polyvinyl alcohol resin, vinyl chloridevinyl acetate copolymer, vinyl chloride-vinyl acetate-maleic anhydride copolymer, vinylidene chloride-acrylonitrile copolymer, styrene-butadiene copolymer and the like, and celluloses such as ethylcellulose, carboxymethylcellulose and the like. One of these materials may be independently, or more than two of them may be combinedly, used for this purpose.

The content of the other resin and fine particles is preferably less than 70 weight % of the subbing resin.

To improve the adhesion as well as mechanical strength, the above-mentioned resin layer may be treated through the following processes: 1 the method to harden the layer by incorporating, as a hardener, an isocyanate compound, epoxy compound or the like; 2 the method to traet the surface of electro-conductive support with a silane class coupling agent, titanium class coupling agent or the like; 3 the method to incorporate such a coupling agent into the resin layer.

The hardeners useful for these processes include hexamethylenetetramine, formaldehyde, paraformadehyde, phenylenediisocyanate, tolylenediisocyanate, hexamethylenediisocyanate, naphthalenediisocyanate, diphenylmethanediisocyanate, triphenylmethanetriisocyanate, bisphenol A diglycidyl ether, resorcin diglycidyl ether, bisphenol F diglycidyl ether, polyalkyleneglycol diglycidyl ether, epoxidized soybean oil, epoxidized linseed oil and others. The silane class coupling agents include β-(3,4-epoxycyclohexyl)ethyltrimethoxysilane, γ-glycidoxypropyltrimethoxysilane, γ-aminopropyltriethoxysilane, N-β-(aminoethy)-γ-aminopropyltrimethoxysilane, N-β-(aminoethyl)-γ-aminopropylmethyldimethoxysilane and the like. The titanium class coupling agents include tetraisopropoxytitanate, tetra-n-butoxytitanate, tetraisopropoxytitanate polymer, tetra-n-butoxytitanate polymer, tri-n-butoxytitanium stearate, diisopropoxytitanium bisacetylacetonate, dihydroxybislactate titanium and the like.

According to the invention, a photosensitive layer is formed on the subbing layer, mentioned above. The photosensitive layer may be a layer comprising a separately provided carrier generating layer and carrier transporting layer, and a surface protective layer may be additionally provided on top of the photosensitive layer.

Carrier generating materials used in the carrier generating layer include such material as guaiazulene pigments (cf. Japanese Patent O.P.I. Publication No. 53850/1984), perylene pigments (cf. Japanese Patent O.P.I. Publication Nos. 24852/1984 and 30330/1972), phthalocyanine pigments (cf. Japanese Patent O.P.I. Publication Nos. 9536/1978 and 9537/1984), pyrylium pigments (cf. Japanese Patent O.P.I. Publication No. 40531/1978), quinacridone pigments (cf. Japanese Patent O.P.I. Publication No. 30332/1972), indigo pigments (cf. Japanese Patent O.P.I. Publication No. 30331/1972), cyanine pigments (cf Japanese Patent O.P.I Publication (No. 21343/1979), azo pigments (cf. Japanese Patent O.P.I. Publication Nos. 194035/1983, 115447/1983, 723757/1984, 72376/1984 and 73820/1984). Among these examples, the azo pigments and phthalocyanine pigments are advantageously used, and the azo pigments are more favorably used.

The azo pigments used in the invention are as follow:

(1) Azo pigments, as described in Japanese Patent O.P.I. Publication No. 21728/1979, having a dibenzothiophene skeleton.

(2) Azo pigments, as described in Jaapnese Patent O.P.I. Publication No. 12724/1979, having an oxadiazole skeleton.

(3) Azo pigments, as described in Japanese Patent O.P.I. Publication No. 22834/1979, having a fluorenone skeleton.

(4) Azo pigments, as described in Japanese Patent O.P.I. Publication No. 20737/1979, having a stilbene skeleton.

(5) Azo pigments, as described in Japanese Patent O.P.I. Publication No 2129/1979, having a distyryloxadiazole skeleton.

(6) Azo pigments, as described in Japanese Patent O.P.I. Publication No. 138646/1982, having an anthraquinone skeleton.

(7) Azo pigments, as described in Japanese Patent O.P.I. Publication No. 182747/1982, having a stilbene skeleton.

(8) $A—N=N—Ar_1—N=N—Ar_2—N=N—A$, as described in Japanese Patent O.P.I. Publication No. 182748/1982.

(9) Azo pigments, as described in Japanese Patent O.P.I. Publication No. 70232/1983, having a styrystilbene skeleton.

(10)

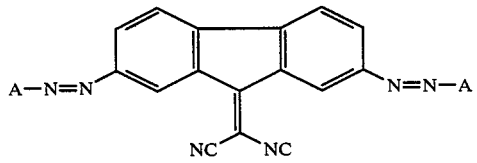

As described in Japanese Patent O.P.I. Publication No. 194035/1983.

(11)

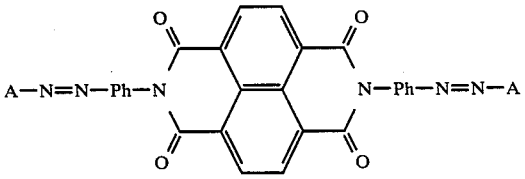

as described in Japanese Patent O.P.I. Publication No. 173748/1983.

(12) Azo pigments, as described in Japanese Patent O.P.I. Publication No. 115447/1983, having a cyanostilibene skeleton.

(13)

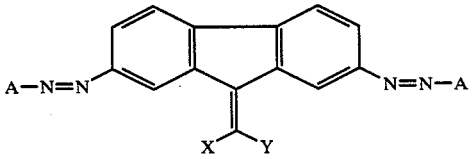

as described in Japanese Patent O.P.I. Publication Nos. 723758/1984, 72376/1984 and 73820/1984.

(14)

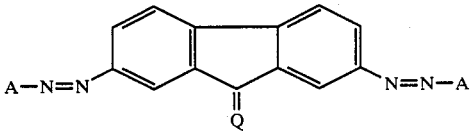

as described in Japanese Patent Application No. 229793/1984.

Among these, the preferred ones are the azo pigments in (10), (13) and (14).

The phthalocyanine pigments advantageously used in the invention are as follows:

(15) Metal-free phthalocyanine pigments described in Japanese Patent Examined Publication Nos. 11021/1970, 12013/1970, 42511/1971 and 42512/1971, and Japanese Patent O.P.I. Publication No. 118474/1985.

(16) Metal phthalocyanine pigments described in Japanese Patent Examined Publication No. 42512/1971, Japanese Patent O.P.I. Publication Nos. 38543/1975, 6731/1976, 141229/1977 and 143827/1977, Japanese Patent Application No. 133284/1978, Japanese Patent O.P.I. Publication Nos. 148745/1982, 44054/1984 and 44053/1984.

Among carrier generating material mentioned above, most preferable one is a compound represented by the following general formula:

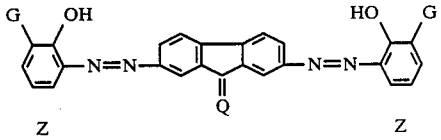

(wherein, =Q is selected from the group consisting of

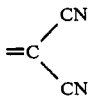

group, =O,

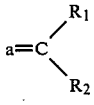

group or an =Ar group wherein $R_1$ and $R_2$ are independently selected from the group consisting of a hydrogen atom, an alkyl group, a substituted or unsubstituted aromatic group and a substituted or unsubstituted heterocyclic group and Ar is a substituted or unsubstituted heterocyclic group; Z is a group of atoms necessary to complete an aromatic hydrocarbon ring or an aromatic heterocyclic ring and G represents a $—CONH—A_1$ or a $—CH=N—NH—A_2$ group wherein $A_1$ and $A_2$ are selected from a substituted or unsubstituted aromatic group.)

The carrier generating layer is preferably formed on the electroconductive support by coating a binder containing dispersed carrier generating material or a solvent containing dissolved carrier generating material. As a means for dispersion, a sand mill, ball mill and the like can be used.

The content of carrier generating material is favorably in the range of 10~400 parts weight, or, more favorably 50~200 parts weight per 100 parts weight binder.

The carrier transporting layer is formed by coating a carrier transporting material and a binder, both of which having been dissolved into an optional appropriate solvent, onto the above-mentioned carrier generating layer or subbing layer.

As a carrier transporting material, the following are available; triazole derivatives (for example, Japanese Patent Examined Publication No. 5467/1959), oxazole derivatives (for example, Japanese Patent Examined Publication No. 1125/1960), oxadiazole derivatives (for example, Japanese Patent Examined Publication No. 5466/1959), pyrazoline derivatives (for example, Japanese Patent Examined Publication No. 10366/1959), imidazole derivatives (for example, Japanese Patent Examined Publication Nos. 11215/1960 and 16096/1962), fluorenone derivatives (for example, Japanese Patent O.P.I. Publications No. 128373/1977 and No. 110837/1979), carbazole derivatives (for example, Japanese Patent O.P.I. Publication No. 59142/1979), and materials described in Japanese Patent O.P.I. Publication Nos. 134642/1983 and 65440/1983.

The content of carrier transporting material is favorably in the range of 25~200 parts weight, or, more favorably 50~100 parts weight per 100 parts weight binder.

As a binder resin used in the photosensititive layer of the invention, various resins can be used combinedly with a carrier generating material or a carrier transporting material. Generally, such resins as polyester, polyethylene, polyamide, polycarbonate, epoxy, poly-N-vinylcarbazole, polystyrene, polyvinylbutyral, polymethylmethacrylate and the like are used for this purpose.

According to the invention, various additives such as silicon oil, ammonium compounds, sensitizers and the like may be incorporated into a photosensitive layer. Among these, low molecule ammonium salt compounds are advantageous.

The typical low molecule ammonium salts are those expressed in the following (a) and (b), and more specifically, those expressed by the formulas I, II and III.

(Formula I)

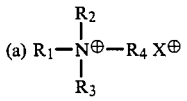

wherein, $R_1$ represents either an acyclic hydrocarbon group which may have a substituent or a cyclic hydrocarbon group which may have a substituent. $R_2$~$R_4$ independently represent a hydrogen atom, an acyclic hydrocarbon group which may have a substituent or a cyclic hydrocarbon group which may have a substituent. $X^{\ominus}$ represents an anion.

As an acyclic hydrocarbon group which may have a substituent, either a saturated or unsaturated acyclic hydrocarbon group is available. Such a saturated acyclic hydrocarbon group is typified by an alkyl group (especially, an alkyl group having 1~20 carbon atoms). Such an unsaturated acyclic hydrocarbon group is typified by an alkenyl group (especially, an alkenyl group having 2~20 carbon atoms), an alkynyl group or an alkadienyl group. Among these, an alkyl group (especially, an alkyl group having 1~20 carbon atoms) and an alkenyl group (especially, an alkenyl group having 2~20 carbon atoms) are favorable, and an alkyl group (especially, an alkyl gropu having 1~20 carbon atoms) is most favorable.

The examples of an alkyl group which is a saturated acyclic hydrocarbon group include a methyl group, ethyl group, n-propyl group, iso-propyl group, n-butyl group, iso-butyl group, tert-butyl group, n-pentyl group, n-hexyl group, n-hoptyl group, n-octyl group, 2-ethylhexyl group, dodecyl group, hexadecyl group, octadecyl group and others. At the same time, the examples of an alkenyl group which is an unsaturated acyclic hydrocarbon group include a vinyl group, allyl group, 3-methyl-2-butenyl group, isopropenyl group, 2-butynyl and others. The examples of an alkynyl group which is an unsaturated acyclic hydrocarbon group include an ethynyl group, butynyl group and others. The examples of an alkakienyl group which is an unsaturated acyclic hydrocarbon group include a 1,3-butanedienyl group and others.

The examples of a substituent which these saturated or unsaturated acyclic hydrocarbon groups may have are as follows: halogen atoms including a fluorine atom, chlorine atom, bromine atom and the like; a cyano group; a hydroxy group; an acyl group; alkoxy groups including a methoxy group, ethoxy group and the like; aryl groups including a phenyl group and the like; aryloxy groups including a phenoxy group and the like.

The examples of an alkyl group which may have a substituent including a benzyl group, phenethyl group, trityl group, diphenylmethyl group, hydroxyethyl group, methoxyethyl group, cyanoethyl group, acetoxyethyl group, acetylethyl group, chloromethyl group and the like. The examples of an alkenyl group which may have the substituent, above, include a styryl group, cinnamyl group and the like.

The examples of a cyclic hydrocarbon group which may have a substituent are as follows; monocyclic hydrocarbon groups which may have a substituent (such as, monocyclic hydrocarbon groups having 3~12 carbon atoms); bridged hydrocarbon groups which may have a substituent (such as, bridged hydrocarbon groups having 6~18 carbon atoms); condensed polycyclic hydrocarbon groups which may have a substituent (such as, condensed polycyclic hydrocarbon groups having 7~18 carbon atoms).

The examples of such mcnocyclic hydrocarbon groups include a cycloalkyl group, monocyclic aromatic group and the like. The examples of such a cycloalkyl group include a cyclopentyl group, cyclohexyl group and the like. The examples of such a monocyclic aromatic group include a phenyl group, cyclododecatrienyl group and the like. The examples of the bridged hydrocarbon groups include a dicyclopentadienyl group, norbonyl group, adamantyl group and the like. The examples of the condensed polycyclic hydrocarbon groups include a naphthyl group, anthryl group, phenanthryl group, indenyl group and the like.

The examples of a substituent these cyclic hydrocarbon groups may have are as follows: halogen atoms including a fluorine atom, chlorine atom, bromine atom and the like; alkyl groups including a methyl group, ethyl group and the like; cyano groups; acyl groups; nitro groups; hydroxyl groups; alkoxy groups including a methoxy group, ethoxy group and the like; aryloxy groups including a phenoxy group; and others.

The examples of a monocyclic hydrocarbon group which may have a substituent, above, include a tolyl group, xylyl group, cumenyl group, mestyl group and the like.

The examples of an anion represented by $X^{\ominus}$ are as follows: halogen anions of fluorine, chlorine, bromine and iodine; inorganic acid anions including a boron tetrafluoride ion, phosphor hexafluoride ion, carbonic ion, sulfuric ion, phosphoric ion, nitric ion, perchloric ion and the like; inorganic anions including a hydroxyl ion and the like; carboxylic ions including an acetic ion, oxalic ion, propionic ion, benzoic ion and the like; sulfonic ions including a benzene-sulfonic ion and the like; alkoxy ions including a methoxy ion, ethoxy ion and the like; and others. Among these, halogen anions and inorganic acid anions are advantageous.

(b) Heterocyclic salts having tetravalent nitrogen

A heterocyclic compound containing a tetravalent nitrogen is, among heterocyclic compounds containing a trivalent nitrogent atom, a heterocyclic compound containing an ionized trivalent nitrogen, and may also contain as a hetero atom a sulfur atom, oxygen atom, selenium atom, arsenic atom, silicon atom, germanium atom, boric atom or the like.

The typical examples of the heterocyclic salt containing a tetravalent nitrogen are the compounds expressed by the following formulas II or III.

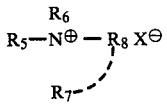

(Formula II)

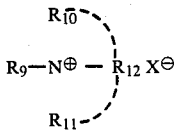

(Formula III)

wherein, $R_5$ and $R_6$ independently represent any one selected from a group comprising a hydrogen atom, acyclic and cyclic hydrocarbon groups which may have a substituent. The acyclic and cyclic hydrocarbon groups which may have a substituent are the same as those previously described for $R_1$. $R_7$ and $R_8$ independently represent a plurality of atoms which is necessary to complete together with a nitrogen atom a heterocycle containing a nitrogen atom. $R_9$ is the same as the above-mentioned $R_5$. $R_{10}$, $R_{11}$ and $R_{12}$ independently represent a plurality of atom which is necessary to complete together with a nitrogen atom a heterocycle containing a nitrogen atom. $X^{\ominus}$ represent an anion identical to the one represented by the previous $X^{\ominus}$.

The typical examples of a parent nucleus of the heterocyclic salt containing a tetravalent nitrogen atom are the following (A)~(K). Into these nuclel a substituent may be incorporated in accordance with requirements.

(A)

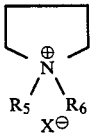

-continued (B)

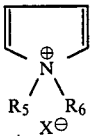

(C)

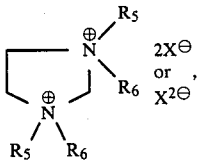

(D)

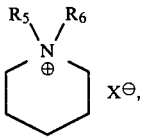

(E)

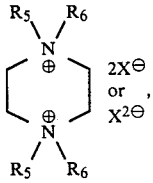

(F)

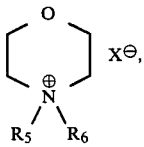

(G)

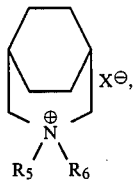

(H)

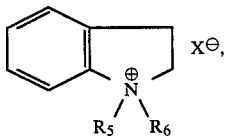

(I)

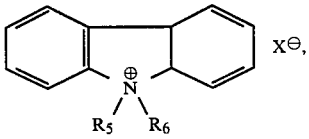

(J)

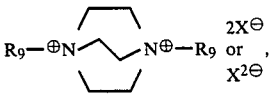

(K)

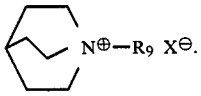

In the formulas (C), (E) and (J), $X^{\ominus}$ represents a monovalent anion. $X^{2\ominus}$ represents a bivalent anion. "$2X^{\ominus}$ or $X^{2\ominus}$" means that $2X^{\ominus}$ or $X^{2\ominus}$ is incorporated into the structural formula to the left of each formula.

In the formula (C), above, two "$R_5$"s independently bonded with different nitrogen atoms may be either identical or different with each other. This applies to $R_6$ in (C), and also to the formula (E) as a whole. In the formula (J), two "$R_9$"s independently bonded with different nitrogen atoms may be either identical or different with each other. In each of (A)~(K), the examples of a substituent being incorporated into a parent nuceus are the same as the substituents described for the formula I.

The typical examples of ammonium salts represented by the formulas II, III, IV and V are as follows:

[Example compounds]

(1) $(CH_3)_2\overset{\oplus}{N}H_2\ Cl^{\ominus}$ (2) $(C_2H_5)_2\overset{\oplus}{N}H_2\ Cl^{\ominus}$ (3) $(n\text{-}C_3H_7)_2\overset{\oplus}{N}H_2\ Cl^{\ominus}$ (4) $(n\text{-}C_8H_{17})_2\overset{\oplus}{N}H_2\ Cl^{\ominus}$ (5) $(n\text{-}C_4H_9)_2\overset{\oplus}{N}H_2\ Cl^{\ominus}$ (6) $(CH_3CH_2CH_2CH_2\underset{\underset{C_2H_5}{|}}{C}HCH_2)_2\overset{\oplus}{N}H_2\ Cl^{\ominus}$ (7) 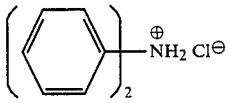

(8) 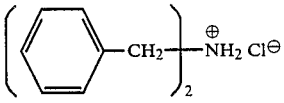

(9) 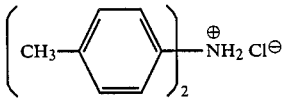

(10) $n\text{-}C_3H_7\text{—}\overset{\oplus}{N}H_3\ Cl^{\ominus}$

(11) $n\text{-}C_4H_9\text{—}\overset{\oplus}{N}H_3\ Cl^{\ominus}$

(12) $n\text{-}C_8H_{17}\text{—}\overset{\oplus}{N}H_3\ Cl^{\ominus}$

(13) $n\text{-}C_{14}H_{29}\text{—}\overset{\oplus}{N}H_3\ Cl^{\ominus}$

(14) $n\text{-}C_{18}H_{37}\text{—}\overset{\oplus}{N}H_3\ Cl^{\ominus}$

(15) 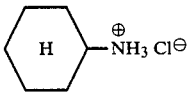

-continued

[Example compounds]

(16) $(C_2H_5)_3\overset{\oplus}{N}H\ Cl^{\ominus}$

(17) $(n\text{-}C_4H_9)_3\overset{\oplus}{N}H\ PF_6^{\ominus}$

(18) $(n\text{-}C_8H_{17})_3\overset{\oplus}{N}H\ Cl^{\ominus}$

(19) $(n\text{-}C_{12}H_{25})_3\overset{\oplus}{N}H\ Cl^{\ominus}$

(20) $(n\text{-}C_4H_9)_2\overset{\oplus}{N}H_2\ BF_4^{\ominus}$

(21) $(n\text{-}C_4H_9)_2\overset{\oplus}{N}H_2\ PF_6^{\ominus}$

(22) 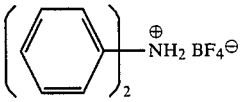

(23) 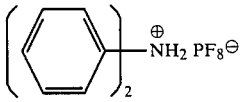

(24) $n\text{-}C_4H_9\overset{\oplus}{N}H_3\ HSO_4^{\ominus}$

(25) $n\text{-}C_4H_9\overset{\oplus}{N}H_3\ NO_3^{\ominus}$

(26) $n\text{-}C_4H_9\overset{\oplus}{N}H_3\ O_4Cl^{\ominus}$

(27) $n\text{-}C_4H_9\overset{\oplus}{N}H_3\ CH_3CH_2COO^{\ominus}$

(28) 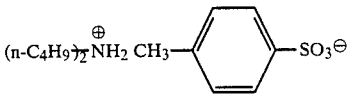

(29) 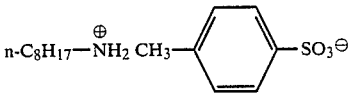

(30) $n\text{-}C_{14}H_{29}\overset{\oplus}{N}H_3\ CH_3CH_2COO^{\ominus}$

(31) $n\text{-}C_{14}H_{29}\overset{\oplus}{N}H_3\ n\text{-}C_{12}H_{25}COO^{\ominus}$

(32) $n\text{-}C_{18}H_{29}\overset{\oplus}{N}H_3\ CH_3CH_2COO^{\ominus}$

(33) $n\text{-}C_8H_{17}\overset{\oplus}{N}(CH_3)_3\ Cl^{\ominus}$

(34) $n\text{-}C_8H_{17}\overset{\oplus}{N}(CH_3)_3\ Br^{\ominus}$

(35) $n\text{-}C_{12}H_{25}\overset{\oplus}{N}(CH_3)_3\ I^{\ominus}$

(36) $(CH_3)_4\overset{\oplus}{N}\ Cl^{\ominus}$

(37) $(C_2H_5)_4\overset{\oplus}{N}\ ClO_4^{\ominus}$

-continued
[Example compounds]
(38)
$(C_2H_5)_4\overset{\oplus}{N}\ OH^{\ominus}$
(39)
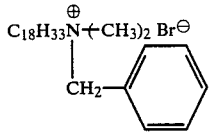
(40)
$(C_{18}H_{37})_2\overset{\oplus}{N}(CH_3)_2\ \overset{\ominus}{Br}$
(41)
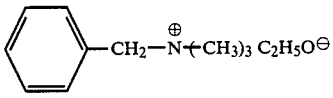
(42)
$(C_2H_5)_4\overset{\oplus}{N}\ C_2H_5O^{\ominus}$
(43)
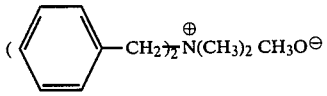
(44)
$(CH_3)_4\overset{\oplus}{N}\ BF_4^{\ominus}$
(45)
$(C_2H_5)_4\overset{\oplus}{N}\ PF_8^{\ominus}$
(46)
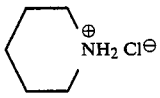
(47)
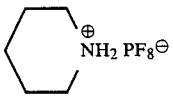
(48)
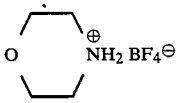
(49)
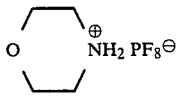
(50)
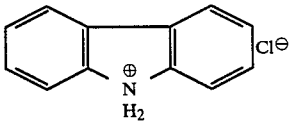
(51)
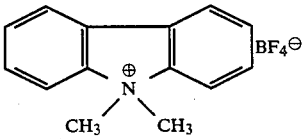
(52)
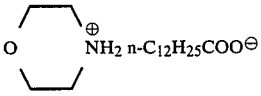
-continued
[Example compounds]
(53)
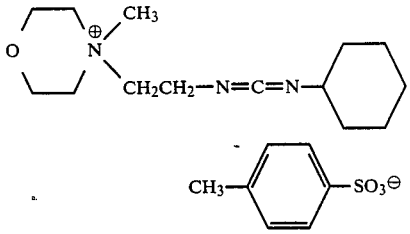
(54)
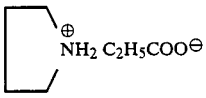
(55)
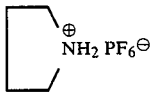
(56)
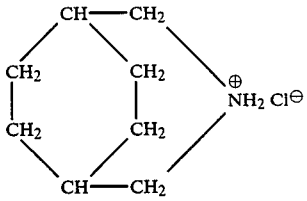
(57)
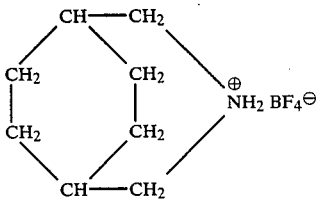
(58)
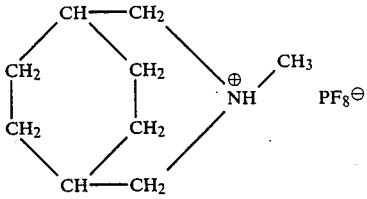
(59)
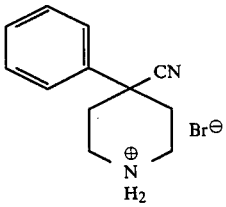
(60)
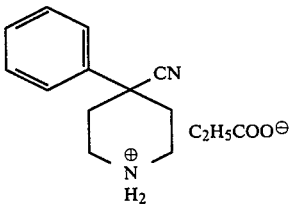

-continued

[Example compounds]

(61)

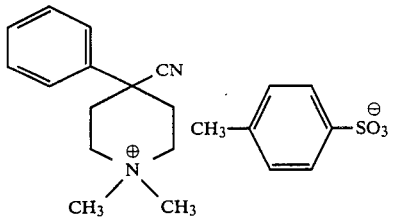

(62)

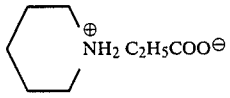

(63)

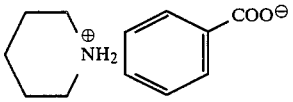

(64)

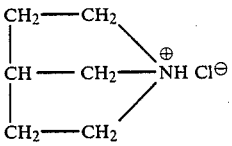

(65)

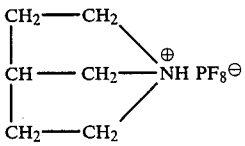

(66)

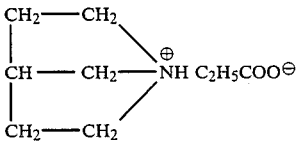

(67)

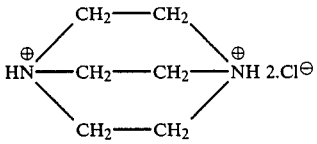

(68)

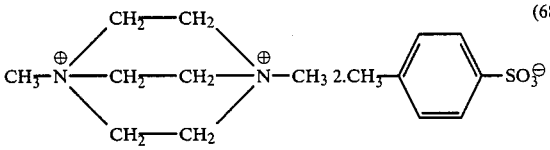

(69)

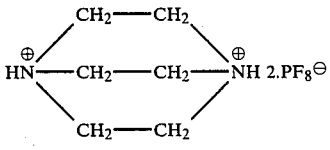

(70)

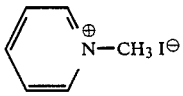

-continued

[Example compounds]

(71)

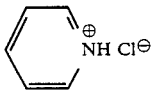

(72)

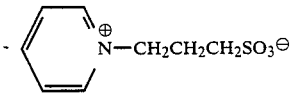

(73)

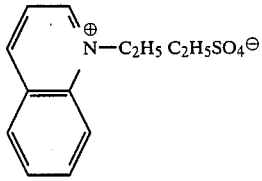

(74)

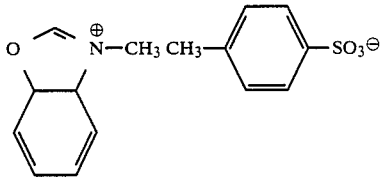

(75)

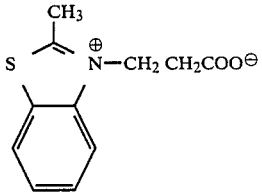

(76)

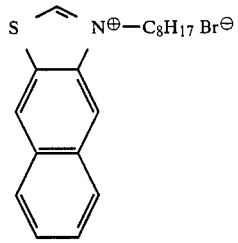

(77)

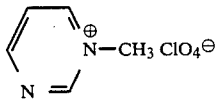

(78)

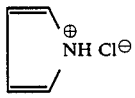

(79)

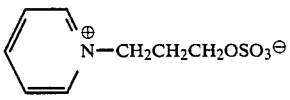

The above-mentioned low molecule ammonium salts can be prepared by the methods described in the literatures including Organic Synthesis Collective Vol. 4, p. 84, and ibid. Vol. 4, p. 96, and by an ordinary synthesizing method. The similar ammonium salt can be easily synthesized by the ordinary method wherein hydrogen chloride gas, hydrochloric acid, sulfuric acid, nitric acid, borofluoric acid, hexafluorophosphate, perchloric acid, phosphoric acid, carbonic acid, carboxylic acid such as acetic acid or sulfonic acid such as benzosulfonic acid is poured into an optional appropriate solution (of acetone or alcohol, for example) containing an amino compound. Also, such ammonium compounds are available in the form of a merchandise produced by Tokyo Kasei Kogyo Co., Ltd., Kanto Kagaku Co., Ltd. or Wako Junyaku Kogyo Co., Ltd.

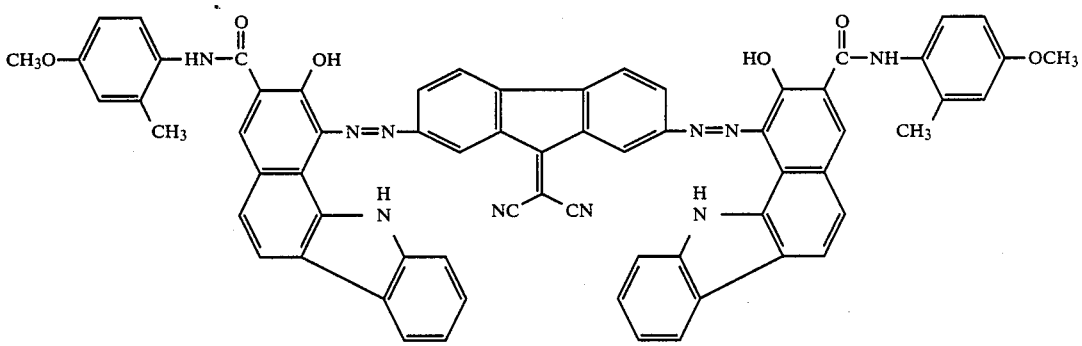

It is advantageous to incorporate the low molecule ammonium salt, above, into whichever a carrier generating layer or a carrier transporting layer. However, the more advantageous layer is the carrier generating layer.

The content of the low molecule ammonium salt is favorably more than 0.1 and less than 50 parts by weight, or, more favorably 0.5~30 parts weight per 100 parts by weight carrier generating material.

As a coating method for the photosensitive layer, the method indentical to that of the subbing layer can be employed. According to one of the most preferable embodiment of the present invention, the photosensitive layer is formed by means of dip coating, whereby a photo-receptor having excellent coating properties and high production yield can be obtained. The thickness of carrier generating layre is favorably 0.05~10 μm, or more favorably 0.1~2 μm. The thickness of carrier transporting layer is favorably 5~50 μm, or more favorably 10~30 μm.

According to the present invention, as can be evidenced by the following examples, it is possible, by providing a subbing layer comprising as a principal component a hydroxystyrene polymer or a copolymer containing hydroxystyrene as a polymeric component, that;

1 a photo-receptor for electrophotography having the satisfactory sensitivity, excellent dark attenuation properties, and satisfactory charge acceptability can be obtained, and that;

2 a photo-receptor for electrophotography being excellent in repeatability and having the stable accepted potential, rest potential and sensitivity properties even after repeated cycles of electrification, exposure and neutralization can be obtained.

[EXAMPLES]

The preferred examples of the present invention are as follows. However, the scope of the invention is not limited only to these examples.

EXAMPLE 1

Ten g of P-hydroxystyrene polymer (product name, Maruzen Resin-M; manufactured by Maruzen Oil Co., Ltd.) was dissolved into 1000 ml mixed solution containing ethyl acetate and dioxane at the ratio of 5:1. The solution was coated on an aluminum plate by dip coating, so as to form a subbing layer being 0.2 μm thick.

Next, 5 g polycarbonate resin (Panlite L-1250, manufactured by Teijin Kasei Co., Ltd.), 10 g azo pigment (charge generating material) represented by the structural formula, below, and 1000 ml 1,2-dichloroethane were blended with a sand mill for 10 hours to prepare a fluid dispersion.

The prepared fluid dispersion was coated on the subbing layer, above, by wire bar coating, and was dried for 10 minutes at 100° C., so as to form a charge generating layer having the thickness about 0.2 μm.

Then, 150 g polycarbonate resin (product name, Panlite K-1300; manufactured by Teijin Kasei Co., Ltd.) and 120 g charge transporting material represented by the structural formula, below, were dissolved into 1000 ml tetrahydrofuran and blended, then coated on the carrier generating layer, above, by dip coating and dried for 20 minutes at 110° C., so as to form a carrier transporting layer having the thickness about 18 μm. The photo-receptor prepared in such a manner was designated the sample 1.

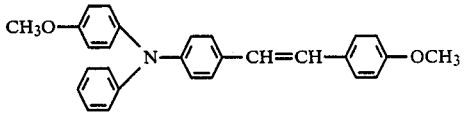

COMPARISON EXAMPLES 1~3

Photo-receptors were prepared similarily to the example 1, except that the subbing layer comprising Maruzen Resin-M was replaced respectively with one of the following subbing layers.

These photo-receptors were designated the comparison samples 1~3.

TABLE 1

| | Resin in subbing layer |
|---|---|
| Comparison example 1 | Without subbing layer |
| Comparison example 2 | Polyvinyl alcohol (Manufactured by Kanto Kagaku Co., Ltd.) |
| Comparison example 3 | Polystyrene (Molecular weight: 51,000) |

EXAMPLES 2~3

Photo-receptors were prepared similarily to the example 1, except that the charge carrier material as well as the carrier transporting matrial were replaced with the following materials. These photo-receptors were designated the samples 2 and 3.

(I) Carrier generating materials

Sample 2

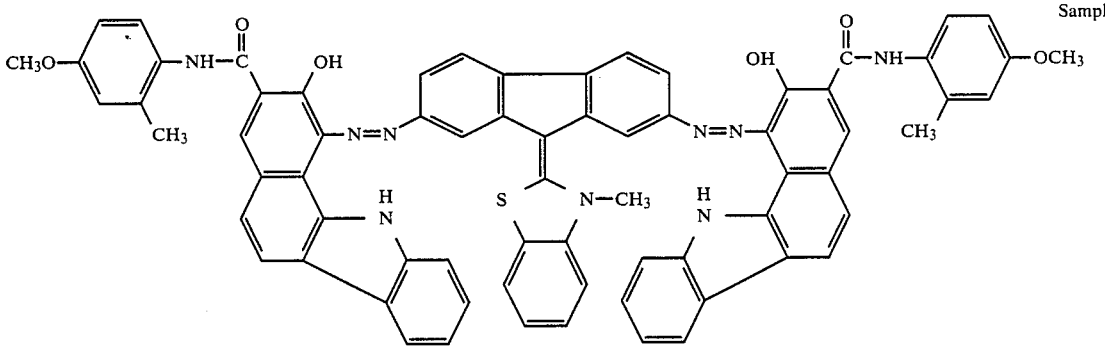

Sample 3

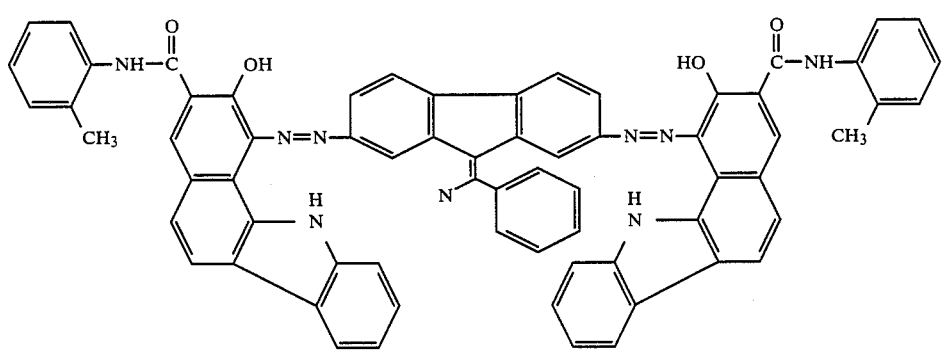

(II) Carrier transporting materials

Sample 2

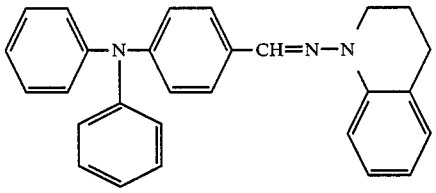

Sample 3

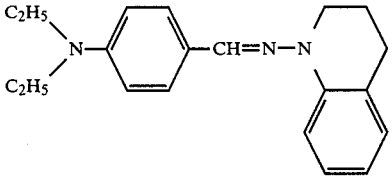

EXAMPLE 4

A photo-receptor was prepared similarily to the example 1, except that the carrier generating material in the photosensitive layer was replaced with a ϵ type copper phthalocyanine pigment (manufactured by Toyo Ink Mfg. Co., Ltd.). This was designated the sample 4.

EXAMPLES 5~6

Photo-receptors were prepared similarily to the example 1 by respectively replacing Maruzen Resin - M with a copolymer of P-hydroxystyrene and methyl methacrilate (composition ratio 1:1), and with a copolymer of P-hydroxystyrene and hydroxyethyl methacrilate (composition ratio 1:1). These were designated the samples 5 and 6.

EXAMPLE 7

A photo-receptor was prepared similarily to the example 1, except that one g dihexylammonium chloride was further added into the prepared azo pigment fluid dispersion so as to prepare the fluid dispersion for forming the charge carrier layer. This was designated the sample 7.

[EVALUATION]

By using the paper analyzer SP-428 (manufactured by Kawaguchi Electric Appliance Co., Ltd.), each of the above-mentioned samples was electrified for five seconds under 40 μA discharging condition, and the surface potential immediately after the electrifaction [$V_A$], the surface potential [$V_I$] after the sample was left in the dark for five seconds, the exposure value [$E_{\frac{1}{2}}$] (Lux.sec) accummulated after the exposure with the surface illumination 2 lux until the surface potential reached $\frac{1}{2}$ $V_I$, and the surface voltage [$V_R$] after the exposure for ten seconds were determined. Accordingly, the dark attenuation ratio [D] was determined based on the formula, below;

$$D = \frac{V_A - V_I}{V_A} \times 100$$

Additionally, the ordinary Carlson process was carried out in order to determine the difference [$\Delta V_B$] between the surface potential immediately after the initial electrification and the similar potential immediately after the 100000th electrification, as well as the rest potential [$V_R'$] after the 100000th electrification.

The results of these measurements are shown in Table - 2.

TABLE 2

| Sample name | $V_A$ | $V_R$ | $E_{\frac{1}{2}}$ | D | $\Delta V_B$ | $V_R'$ |
|---|---|---|---|---|---|---|
| Sample | | | | | | |
| 1 | 1230 | 0 | 2.0 | 21.5 | 100 | 0 |
| 2 | 1180 | 0 | 2.3 | 23.0 | 130 | 0 |
| 3 | 1240 | 0 | 2.4 | 23.0 | 150 | 0 |
| 4 | 1060 | 5 | 2.9 | 25.4 | 210 | 0 |
| 5 | 1230 | 0 | 2.4 | 22.1 | 120 | 0 |
| 6 | 1260 | 0 | 2.4 | 21.5 | 120 | 0 |
| 7 | 1350 | 0 | 2.2 | 20.0 | 80 | 0 |
| Comparison sample | | | | | | |
| 1 | 980 | 5 | 3.5 | 28.2 | 360 | 0 |
| 2 | 1210 | 40 | 5.1 | 20.0 | 80 | 220 |
| 3 | 1250 | 50 | 4.9 | 22.2 | 70 | 180 |

As the table illustrates, the sample without a subbing layer has the low $V_A$, poor charge acceptability, large $\Delta V_B$ and poor repeatability.

Additionally, the subbing layers not in accordance with the invention show a large $E_{\frac{1}{2}}$, a poor sensitivity, a large rest potential [$V_R$], and accordingly, the $V_R'$ becomes greater due to the repeated use.

In contrast, with the provision of the subbing layer of the invention, the markedly excellent properties can be provided, and the photo-receptor excellent in the sensitivity, charge retaining properties and repeatability can be obtained.

What is claimed is:

1. An electrophotographic photoreceptor adapted to repeatedly form electrostatic toner images through dry development, said photoreceptor comprising;

an electroconductive support and a subbing layer thereon containing a hydroxystyrene as a monomer substituent thereof and a photoreceptive layer containing a carrier generating material.

2. The photo-receptor of claim 1, wherein said polymer is a hydroxystrene homopolymer.

3. The photo-receptor of claim 1, wherein said polymer is a hydroxystyrene copolymer.

4. The photo-receptor of claim 1, wherein said photosensitive layer comprises said first layer containing a carrier generating material and said layer containing a carrier transporting material.

5. The photo-receptor of claim 1, wherein said photosensitive layer comprises said first layer containing a carrier generating material and said carrier transporting material and a second later containing said carrier transporting material.

6. The photo-receptor of claim 1, wherein said carrier generating material is an azo pigment.

7. The photo-receptor of claim 1, wherein said carrier generating material is a phthalocyanine pigment.

8. The photo-receptor of claim 1, wherein said subbing layer has a thickness ranging from 0.01 to 10 μm.

9. The photo-receptor of claim 4, wherein subbing layer has a thickness ranging from 0.01 to 10 μm, said carrier generating layer has a thickness ranging from 0.05 to 10 μm and said carrier transporting layer has a thickness ranging 0.05 to 50 μm.

10. The photo-receptor of claim 9, wherein said subbing layer has a thickness ranging from 0.05 to 2 μm, said carrier generating layer has a thickness ranging from 0.1 to 2 μm and said carrier transporting layer has a thickness ranging 10 to 30 μm.

11. The photo-receptor of claim 4, wherein said carrier generating material is an zero azo pigment.

12. The photo-receptor of claim 5, wherein said carrier generating material is an azo pigment.

13. The photo-receptor of claim 4, wherein said carrier generating material is a phthalocyanine pigment.

14. The photo-receptor of claim 5, wherein said carrier generating material is a phthalocyanine pigment.

15. The photo-receptor of claim 4, wherein said generating material is a compound represented by the following general formula:

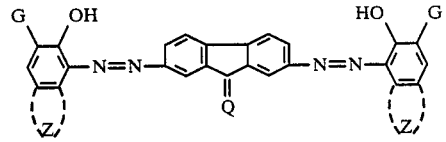

(wherein =Q is selected from the group consisting of

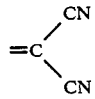

group, =O,

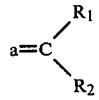

group or an =Ar group wherein $R_1$ and $R_2$ are independently selected from the group consisting of a hydrogen atom, an alkyl group, a substituted or unsubstituted aromatic group and a substituted or unsubstituted heterocyclic group and Ar is a substituted or unsubstituted hetercyclic group; Z is a group of atoms necessary to complete an aromatic hydrocarbon ring or an aromatic heterocyclic ring and G represents a —CONH—$A_1$ or a —CH=N—NH—A, group wherein $A_1$ and $A_2$ are selected from a substituted or unsubstituted aromatic group.)

16. The photo-receptor of claim 5, wherein said generating material is a compound represented by the following general formula:

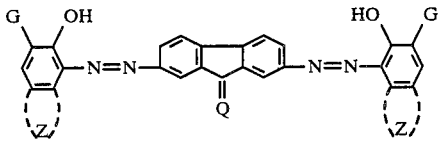

(wherein =Q is selected from the group consisting of

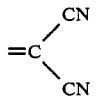

group, =O,

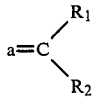

group or an =Ar group wherein $R_1$ and $R_2$ are independently selected from the group consisting of a hydrogen atom, an alkyl group, a substituted or unsubstituted aromatic group and a substituted or unsubstituted heterocyclic group and Ar is a substituted or unsubstituted heterocyclic group; Z is a group of atoms necessary to complete an aromatic hydrocarbon ring or an aromatic heterocyclic ring and G represents a —CONH—$A_1$ or a —CH=N—NH—$A_2$ group wherein $A_1$ and $A_2$ are selected from a substituted or unsubstituted aromatic group.)

17. The photo-receptor of claim 4, wherein said photo-sensitive layer has been formed by dip coating.

18. The photo-receptor of claim 5, wherein said photo-sensitive layer has been formed by dip coating.

19. The photoreceptor of claim 1 wherein said photo-sensitive layer further comprises a carrier transporting material.

20. The photo-receptor of claim 19, wherein said carrier genrating material is a compound represented by the following general formula:

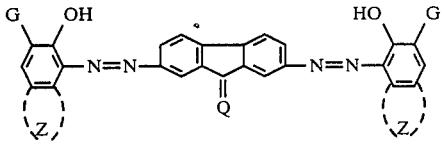

(wherein, =Q is selected from the group consisting of

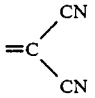

group, =O,

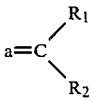

group or an =Ar group wherein $R_1$ and $R_2$ are independently selected from the group consisting of a hydrogen atom, an alkyl group, a substituted or unsubstituted aromatic group and a substituted or unsubstituted heterocyclic group and Ar is a substituted or unsubstituted heterocyclic group; Z is a group of atoms necessary to complete an aromatic hydrocarbon ring or an aromatic heterocyclic ring and G represents a —CONH—O—$A_1$ or a —CH=N—NH—$A_2$ group wherein $A_1$ and $A_2$ are selected from a substituted or unsubstituted aromatic group.)

21. The photo-receptor of claim 19, wherein said photo-sensitive layer has been formed by dip coating.

* * * * *